US007111749B1

(12) United States Patent
Akers

(10) Patent No.: US 7,111,749 B1
(45) Date of Patent: Sep. 26, 2006

(54) COVER PIECE AND METHOD FOR COFFEE CUP LIDS

(76) Inventor: Paul Akers, 3725 Irongate Rd., #105, Bellingham, WA (US) 98226

( * ) Notice: Subject to any disclaimer, the term of this patent is extended or adjusted under 35 U.S.C. 154(b) by 160 days.

(21) Appl. No.: 10/754,413

(22) Filed: Jan. 9, 2004

Related U.S. Application Data

(63) Continuation of application No. 10/157,383, filed on May 28, 2002, now abandoned, which is a continuation of application No. 09/654,592, filed on Sep. 1, 2000, now abandoned.

(60) Provisional application No. 60/152,776, filed on Sep. 3, 1999.

(51) Int. Cl.
*B65D 51/18* (2006.01)
*B65D 17/34* (2006.01)

(52) U.S. Cl. ..... 220/359.2; 220/254.1; 220/716; 220/714; 229/404; 229/906.1

(58) Field of Classification Search ..... 220/254.1, 220/359.1, 359.2, 359.3, 711, 713, 714, 715, 220/716, 719; 229/404, 906.1
See application file for complete search history.

(56) References Cited

U.S. PATENT DOCUMENTS

| | | | | |
|---|---|---|---|---|
| 2,740,547 | A | 4/1956 | Huntting | |
| 3,292,828 | A | 12/1966 | Stuart | |
| 3,312,368 | A | 4/1967 | Reynolds et al. | |
| 3,338,462 | A * | 8/1967 | Reynolds et al. | 220/791 |
| 3,389,827 | A | 6/1968 | Abere et al. | |
| 3,935,960 | A * | 2/1976 | Cornell | 220/260 |
| 3,966,081 | A * | 6/1976 | Kawamata | 220/270 |
| 3,990,615 | A * | 11/1976 | Kerwin et al. | 222/541.9 |
| 4,243,156 | A | 1/1981 | Lobbestael | |
| 4,318,490 | A * | 3/1982 | Schneider | 215/232 |
| 4,333,583 | A | 6/1982 | Montemarano | |
| 4,356,935 | A | 11/1982 | Kamin | |
| 4,397,401 | A | 8/1983 | Ueno et al. | |
| 4,503,992 | A | 3/1985 | Sitko et al. | |
| 4,526,287 | A | 7/1985 | Miyamatsu et al. | |
| D283,983 | S * | 5/1986 | Fellows et al. | D9/499 |
| 4,589,569 | A | 5/1986 | Clements | |
| 4,595,114 | A | 6/1986 | Lu | |
| 4,782,975 | A | 11/1988 | Coy | |
| 4,899,902 | A | 2/1990 | DeMars | |
| 5,375,698 | A | 12/1994 | Ewart et al. | |
| 5,588,552 | A | 12/1996 | Johnson | |
| 5,645,191 | A | 7/1997 | Neville | |
| 5,653,383 | A | 8/1997 | Adachi et al. | |
| 6,129,268 | A | 10/2000 | Stahlecker | |
| 6,578,723 | B1 * | 6/2003 | Tyner | 215/232 |

* cited by examiner

*Primary Examiner*—Nathan J. Newhouse
*Assistant Examiner*—James Smalley
(74) *Attorney, Agent, or Firm*—Michael R. Schacht; Schacht Law Office, Inc

(57) ABSTRACT

A cover piece and method for covering an opening of a drinking container, such as in the lid of a coffee cup. The cover piece has sufficient flexural stiffness so that it can be grasped conveniently and properly positioned over the opening, and yet is sufficiently flexible so that it can properly perform its opening operation. It comprises a cover section having a greater lateral length dimension, and a tab extending outwardly from the cover portion when the cover piece is in the covering position.

3 Claims, 5 Drawing Sheets

COVER PIECE AND METHOD FOR COFFEE CUP LIDS

RELATED APPLICATIONS

This application is a continuation and claims the benefit of U.S. patent application Ser. No. 10/157,383 filed on May 28, 2002 now abandoned which is a continuation of U.S. patent application Ser. No. 09/654,592 filed on September 1, 2000, now abandoned which claimed the benefit of U.S. Provisional Application Ser. No. 60/152,776, filed on Sep. 3, 1999.

FIELD OF THE INVENTION

The present invention relates to a cover piece and method for covering the opening in the lid for a coffee cup, and more particularly to such a cover piece which has an adhesive layer and which can conveniently and reliably be placed over the opening to prevent spilling of the coffee, and can easily and reliably be removed and replaced.

BACKGROUND OF THE INVENTION

One common way for restaurants to serve coffee to customers is with a disposable cup, which often has a disposable lid, covering the cup in which the coffee is being served. This is done in fast food restaurants which serve the food and coffee over the counters, where it can be taken off the premises. Also, these are used for drive-through restaurants where the car drives to a service window, and the coffee and also other beverages and/or food are served through the window. There are a number of establishments which serve coffee and/or other beverages exclusively for drive-through customers.

Some types of lids for these coffee cups have an opening at the perimeter of the lid which permits the person to drink coffee while leaving the lid in place in its closing position. When the coffee cup is being handled or passed from one person to another, the movement of the coffee within the cup can sometimes cause the coffee to spill through the opening.

It has been a practice in some drive-in or drive-through restaurants to use a piece of flexible adhesive material (similar to adhesive tape that is commonly used to cause a bandage to be placed against the person's skin) to cover the lid opening when the coffee is being served. Then the person can remove the adhesive cover when he or she begins drinking the coffee. Generally, the person who is to drink the coffee will simply take the adhesive piece off and dispose of it.

A search of the patent literature has revealed a number of patents relating to different configurations of closed containers that permit the person to drink from the container and various types of covers for these and other items. These patents are the following:

U.S. Pat. No. 5,645,191 (Neville) shows a spout built on a lip of a cup portion and a lid portion. It is closed by hinged flap 54, that is provided with a tab 56 that is a releasable holding means to keep the flap closed.

U.S. Pat. No. 5,375,698 (Ewart et al) shows a container for holding and treating contact lenses. The lower section has fluid holding basin sections, and an upper cover sheet to seal the basins. The cover material is held in place by an adhesive that can be repeatedly used in a wet environment.

U.S. Pat. No. 4,899,902 (DeMars) shows a spout lid that is provided with a cover that is retained tightly enough to provide a fluid tight seal. The cover is attached to the lid by an integral strap element.

U.S. Pat. No. 4,782,975 (Coy) shows a lid spout that is provided with a valve that prevents leakage during use. There is a cover element 16, in place before use that is secured by adhesive. The cover element 16 is removed when the spout is about to be used.

U.S. Pat. No. 4,333,583 (Montemarano) shows a cup lid that has a spout provided with a closure element 24, and that is held in place by perforations that are broken when the cup is to be used. There is a thumb tab 26 that aids in opening and may be provided with adhesive to aid in resealing.

U.S. Pat. No. 4,243,156 (Lobbestael) shows a spout that is provided with removable cover. There are perforations in the material between the cover and the spout so that the cover may be easily removed.

U.S. Pat. No. 3,389,827 (Abere et al) shows a sealing element held over an opening in a fluid container by adhesive.

SUMMARY OF THE INVENTION

The present invention relates to covers and methods for selectively covering a drinking opening in beverage container assembly. The present invention is optimized for use with conventional beverage container assemblies that comprise a cup and a lid. In such conventional container assemblies, the drinking opening is typically formed in an upper wall of a raised portion of the lid.

The cover comprises a substantially planar cover member comprising first and second layers and defining a cover portion, a surrounding cover portion, a tab portion, and a perimeter edge. The first layer is a structural layer having flexural characteristics that allow the cover member to be transported by engaging opposing portions of the perimeter edge of the cover member without substantially deforming the cover member. The second layer defines an adhesive surface adapted to detachably attach the cover member to the lid.

In use, the cover member is attached to the container assembly in a cover mode by engaging the opposing edge portions of the cover member and bringing the surrounding cover portion of the cover member into contact with the upper wall of the raised portion of the lid. In this configuration, the adhesive surface on the surrounding cover portion of the cover member adheres to the lid. With the cover member adhered to the lid in the cover mode, the surrounding cover portion extends completely around the drinking opening, the cover portion extends over the drinking opening, and at least a portion of the tab portion of the cover member extends into free space from the raised portion of the lid.

The cover member is detached from the container assembly by applying deliberate manual force to the tab portion of the cover member to overcome the adhesion of the second layer of the cover member to the lid.

In the method of the present invention, a cover member is provided as indicated above, and the steps are performed properly utilizing the cover piece for both covering, removing, and then repositioning the cover to again cover the opening.

Also, several embodiments are shown where the cover piece is shaped in different configurations of a more artistic or imaginative nature.

Other features will become apparent from the following detailed description.

DETAILED DESCRIPTION

Figure 1:
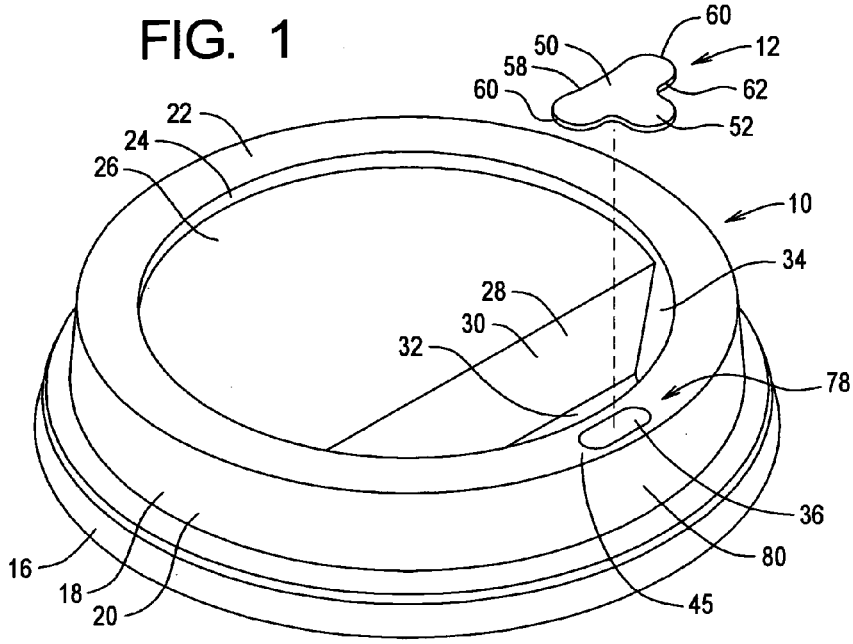
FIG. 1 is an isometric view of a prior art cover cap and also showing the cover piece of the present invention positioned above the cover cap.
Figure 4:
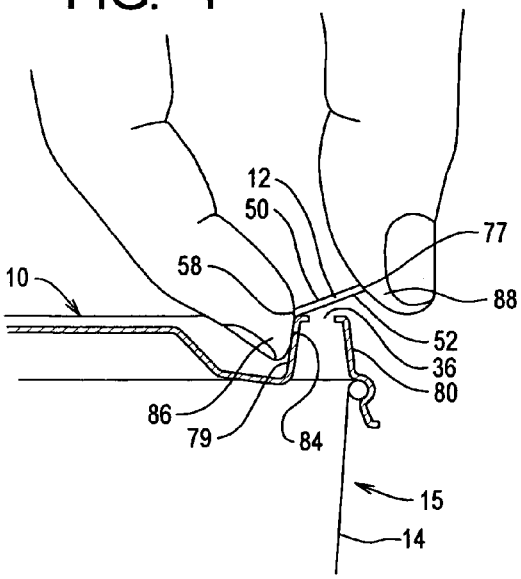
FIGS. 4, 5 and 6 are three drawings showing the lid of the coffee cup in cross section, and illustrating the steps of one method by which the cover piece can be applied to close the opening in the lid.
Figure 5:
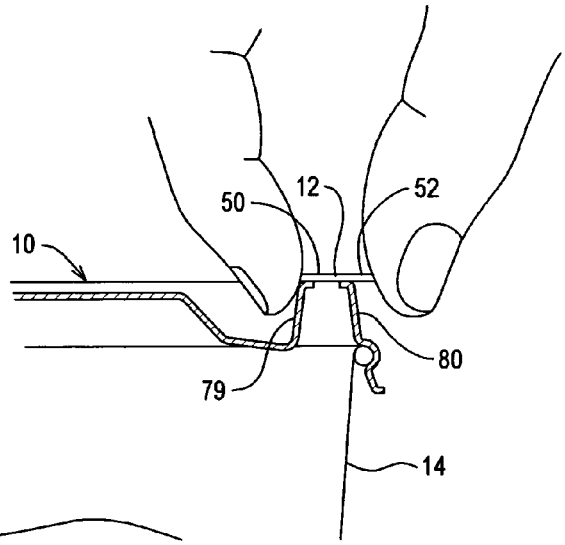
Figure 6:
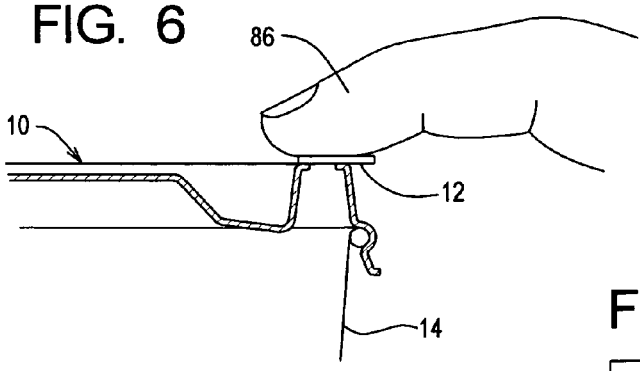

In FIG. 1, there is shown a prior art lid 10 and the cover piece 12 of a first embodiment of the present invention in a position where the cover piece 12 can be lowered into covering engagement with the lid 10. In FIGS. 4–6, the lid 10 is shown in its covering position at the upper end of a prior art cup 14 which may be a coffee cup (the lower end of which is not shown for ease of illustration). This lid 10 and the cup 14 together form a drinking container 15.

The lid 10 comprises a lower perimeter flange 16, which extends around the upper rim of the coffee cup 14. Spaced a short distance radially inwardly from the outer perimeter flange 16, there is a raised perimeter portion 18, comprising an outer perimeter wall 20 having an upward and radially inward slant, a top horizontal perimeter wall 22 extending radially inwardly from the outer wall 20, and then relatively short downwardly extending, inwardly facing circumferential lip 24. Connected to the lip 24 is horizontal cover portion 26 having a generally circular configuration.

The cover portion 26 has a downwardly formed recessed portion 28 in the form of a segment of a circle having a generally vertically aligned planar recess wall 30 spaced a short distance away from the center of the cover portion 26, a bottom wall 32 and a circularly radially outward, curved outer recess wall 34 which is axially aligned with, and a downward extension of, the inner lip 24.

There is an elongated opening 36 formed in the top wall 22 adjacent to (and radially outward from) the wall 34 of the recess 28. The surface portion of the recessed curved outer wall 34, designated 38, functions as a positioning surface for the application of the cover piece 12. (This will be discussed in more detail later herein.)

The opening 36 has an inner edge 40 and an outer edge 42 which are parallel to one another, and lateral edges 44 which are each formed in a 180 degree curve. This perimeter edge 40/42/44 has the overall configuration of a racetrack. The dimensions of the opening 36 are sufficiently small so that there is a perimeter surface portion 45 of the top wall 22 extending entirely around the opening 36.

The aforementioned cover piece 12 comprises a cover layer 46 made of a moderately stiff, yet bendable plastic material, and having an adhesive layer 48 on its lower surface. This cover piece 12 comprises a cover section 50 and a tab portion 52. The cover piece 12 can be considered as having a radial axis 53 which, with the cover piece 12 in its closing position, extends radially from the center of the lid 10, and a perimeter axis 54 extending perpendicular to the radial axis 53.

The cover section 50 has a width dimension (shown at 55) of about ¼ inch, and an overall length dimension 56 of about ¾ inch. The cover section therefore has an elongated "racetrack" configuration similar to that of the opening 36, comprising a radially inward edge portion 58, two lateral end edge portions 60 having a 180 degree outer edge, and two radially outward portions 62 on opposite sides of the tab 52. The radially inward edge 58 and the two edge portions 62 follow the curve of the raised perimeter portion 18 and are positioned a very short distance inside of the upper edges of the top wall 22 of the raised perimeter portion 18.

Figure 2:
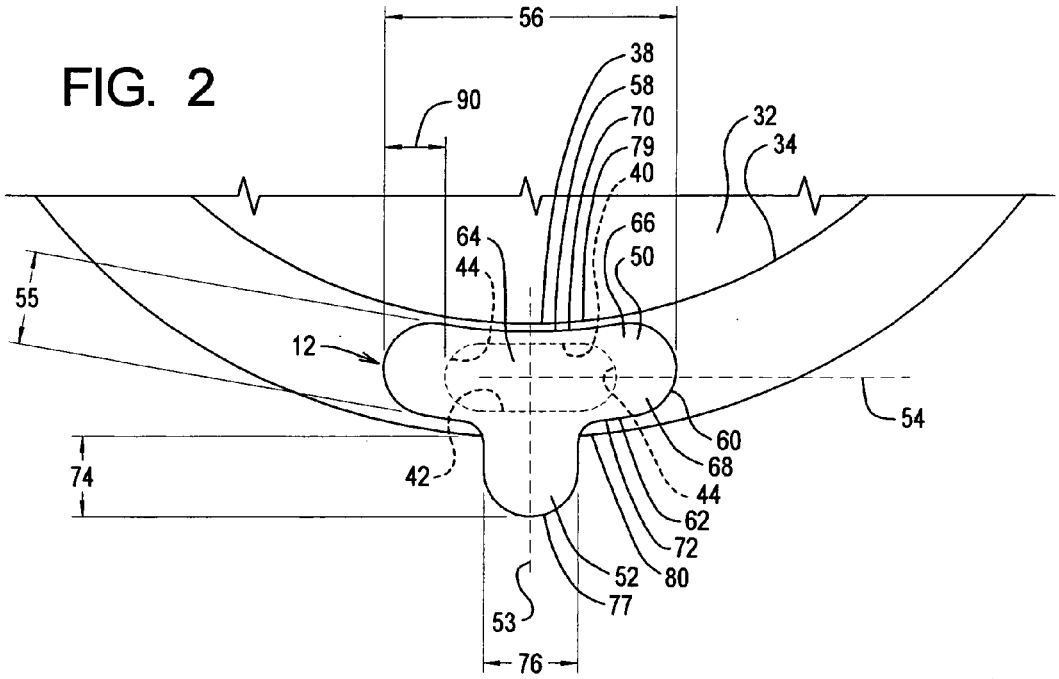
FIG. 2 is a top plan view of a portion of the lid of FIG. 1, showing the cover piece in place.
Figure 2A:
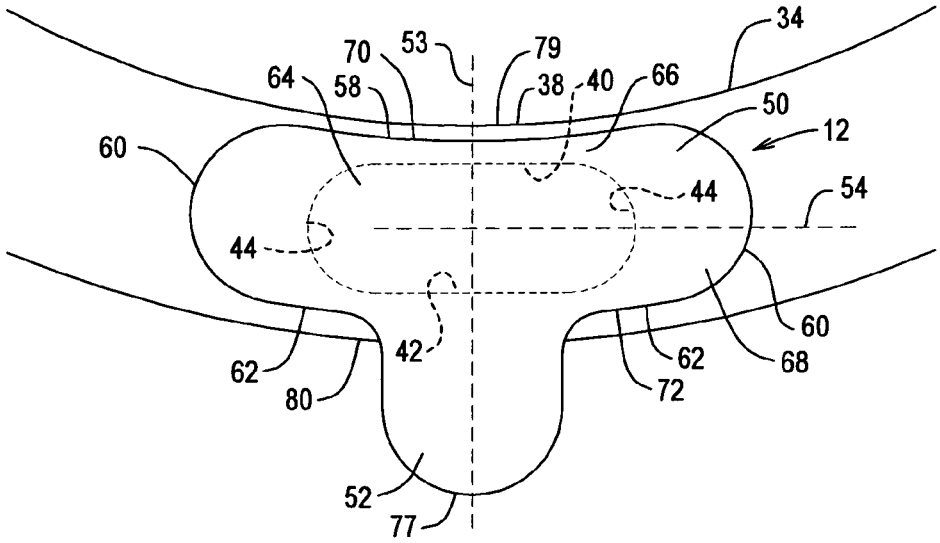
FIG. 2A is a plan view similar to FIG. 2, showing to an enlarged scale the opening perimeter portion of the cup lid with the cover piece in place over the opening. This drawing of FIG. 2A being given to permit the numerical designations to be inserted more clearly.
Figure 3:
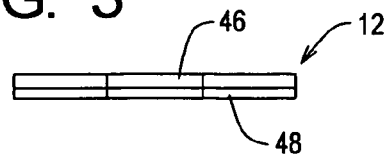
FIG. 3 is a front elevational view of the cover cap, showing the main cover layer and also the adhesive layer.

The cover piece 12 is shown in its proper position, applied to the lid 10, in FIG. 2. Therefore, in terms of function, the cover section 50 can be considered as having an inner covering portion 64 which in its covering position is coincident with the lid opening 36, and a surrounding perimeter portion 66 made up of two lateral perimeter portions 68 and radially inward and outward elongate perimeter portions 70 and 72, respectively.

The tab 52 extends radially outwardly beyond the outer edge of the top wall 22 of the raised perimeter portion 18 when the cover piece 12 is in its covering position in FIG. 2 by a short distance (0.25 inch, this dimension being shown at 74 in FIG. 2). The width dimension (indicated at 76) of the tab 52 is approximately 0.25 inch. The outer edge 77 of the tab 52 is in a 180 degree curve. Thus, the tab 52 is dimensioned so that it can conveniently be grasped by the person's thumb, while the inward edge 58 is grasped by the person's forefinger.

The portion of the lid 10 that is adjacent to the opening 36 can, for purposes of describing the configuration and function of the present invention, be considered as a perimeter opening region 78, comprising the opening 36, a radially inward surface portion 78 of the recess wall 34 adjacent to the opening 36, a radially outward portion 80 of the wall 20 adjacent to the opening 36 and the adjacent surface portions of the upper wall 24 to which the cover piece 12 adheres.

The aforementioned adhesive layer 48 extends over the entire bottom surface of the cover piece 12, and this is a contact adhesive which adheres to the underlying surface when it is applied to the underlying surface and moderate pressure is applied to the member 12. Also, the contact adhesive is such that it can be removed from its bonded position and replaced onto the cup lid surface a number of times, with the adhesive still being able to have a releasable bond to the underlying surface. Also, in this particular application the material from which this adhesive is made is a non-toxic material so that if the coffee within the cup splashes against the adhesive material there would be no contamination to the person who is drinking the coffee. A suitable adhesive is acrylic transfer (Acrylic PSA). A rubber-based adhesive could work; however, acrylic transfer has desirable water resistive properties.

The plastic cover layer 46 of the cover piece 12 is made of a plastic material which is approximately 0.02 to 0.03 inches thick. The cover piece 12 is moderately stiff, and yet it can be readily flexed from the planar position by a moderate application of moderate pressure when grasped in a person's thumb and forefinger.

It has been found that this particular configuration and structure of the cover piece 12 permits it to be very conveniently applied to the lid 10 to cover the opening 36, easily removed from the lid 10 and also placed again in its covering position. Further, this can be accomplished a number of times. Thus, the cover piece 12 can be readily placed into its covering position by the person who is serving the coffee, and this can be done very quickly (and yet reliably). Then when the customer receives the cup of coffee with the cover piece 12 over the lid 10, the customer can easily remove the cover piece, drink a portion of the coffee, and replace the cover piece 12 in its closing position, this being done also with relative ease and also with a reliable closure being accomplished.

Figure 7:
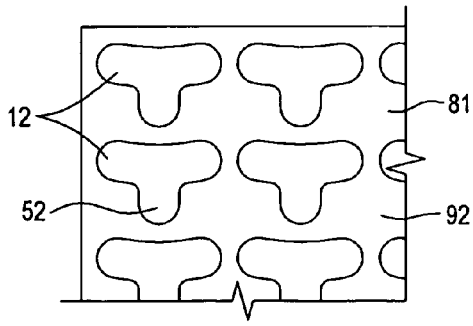
FIG. 7 is a top plan view showing a plurality of the cover pieces being mounted to a substrate in a manner so that these can easily be removed for use in covering the lid openings.
Figure 8:
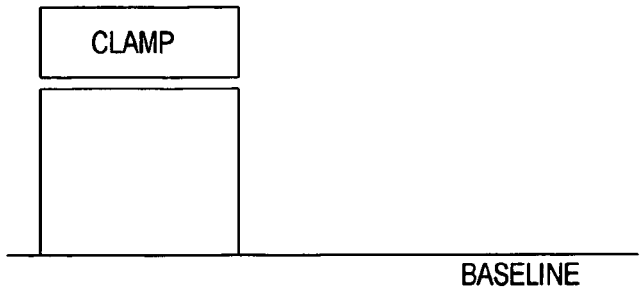
FIGS. 8–11 are side elevational views of the Test procedures used to determine flexural stiffness.
Figure 9:
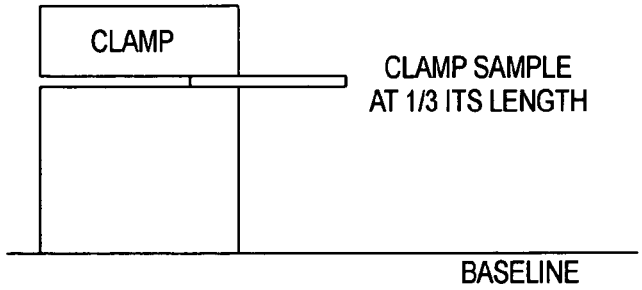
Figure 10:
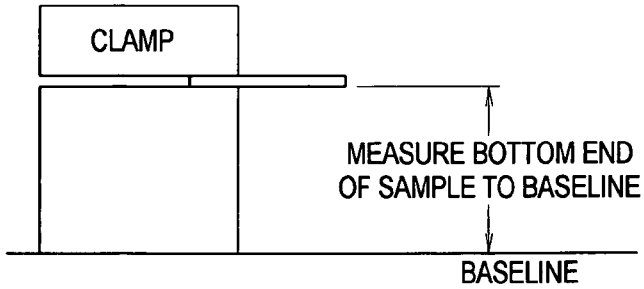
Figure 11:
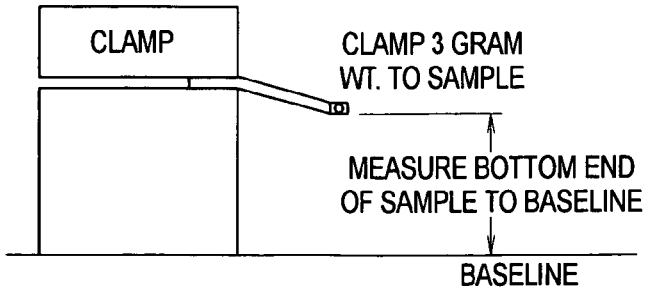

To explain the method of application of the present invention in more detail, reference is now made to FIGS. 4 through 7. As shown in FIG. 7, there is a plurality of the cover pieces 12 which are placed on a flexible cardboard member 81 so as to adhesively adhere to the cardboard member 81. The person grasps one of the cover pieces 12 by the tab 52 and lifts the cover piece from the underlying cardboard 81.

While different techniques may be used to place the cover piece 12 over the opening 36, one particularly effective technique is to grasp the cover piece 12 so that the surface end portion 84 near the end of the person's forefinger 86 engages the inside edge 58 of the cover section 50, with the thumb surface near the outer end of the thumb 88 engaging the outer edge 77 of the tab 52.

Then the cover piece 12 is moved into the position of FIG. 4 so that the inside edge 58 of the cover section 56 is adjacent to the middle rear edge portion of the top wall 22. In this position, the front surface portion 86 of the end portion of the person's finger 82 comes into engagement with the surface portion 79 of the positioning surface 38 of the recess 28, and the end of the person's forefinger extends into the recessed portion 28. With this being done, the cover piece becomes properly aligned with the opening 36. Then the cover member can be rotated to the position of FIG. 5, after which the cover piece 12 can then be pressed into proper contact, with the perimeter surface portion of the cover member 12 surrounding the opening 36.

Another method of applying the cover piece 12 to opening 36 is to grasp primarily the tab 52 with the forefinger on top of the cover piece 12 and the thumb below and position the radially inward part of the cover piece just behind the opening 36 and then press the middle and forward part of the cover piece 12 downwardly with moderate downward force being applied, with the cover piece 12 flexing moderately while maintaining its alignment with the opening 36.

It will be noted that the two lateral perimeter positions each extend beyond the lateral edges 44 of the opening 34 by a distance much greater than the perimeter portions 70 and 72, as shown by the dimension indicated at 90 in FIG. 2. In this embodiment this dimension 90 is between about ⅛ to ¼ of an inch. This provides a greater margin of error in the lateral direction in placing the cover piece 10 over the opening 36, and it also provides a larger contact area for adherence of the cover piece 12 to the surface area of the upper wall 22.

Also, with the tab 52 extending beyond the wall portion 80, the cover piece can be easily removed by grasping the tab 52 between the thumb and the forefinger and lifting the cover piece 12 upwardly.

As indicated previously, it is desirable that the plastic cover layer 46 should be made so that its thickness, and also the characteristics of the material, are such that it is sufficiently stiff so that it could be grasped and manipulated in the manner shown in FIGS. 4 and 5. In that way, the material retains its proper configuration during the application of the cover piece 12. Also, when the tab 52 is grasped to remove the cover piece 12 from its closing position over the lid opening 36, the cover piece 12 maintains its original shape. Therefore, it can be set aside and reapplied without any difficulty.

On the other hand, it is desirable to have a certain amount of flexibility. For example, during the application process when the cover piece 12 is in the position of FIG. 4, one maneuver that is sometimes desirable is for a person to roll the surface 84 of the forefinger 86 over the inner edge surface portion of the cover piece 12 to hold the cover piece 12 in its proper position relative to the opening 36, and then the tab portion is released by the thumb 84 so that it snaps downwardly into place. Alternatively, the person may simply depend on the positioning of the forefinger 86 and the thumb to maintain proper alignment.

Further, there may be deviations of the planar surface portion surrounding the opening 36, and there should be sufficient flexibility to enable the cover piece 12 to conform to the surface and form a proper seal.

Referring now to FIG. 7, depicted therein is a top plan view showing a plurality of the cover pieces 12 being mounted to a substrate 92. One of the plurality of cover pieces 12 can easily be removed for use in covering a lid opening 36 in a lid 10.

The flexural stiffness of the cover piece 12 should be within a desired range. The flexural stiffness can be determined with reasonable accuracy under the test provisions specified as ASTN D 790-96cn. The manner in which these tests are accomplished is illustrated in FIGS. 8 through 11. The criteria for this test are as follows:

a. Material samples are all to be of common dimensions. For the purpose of this test the sample size is 2"×0.5"×0.020".

b. Material samples to be stabilized for 2 hours at 20 degrees C+/−2 degrees.

c. Establish a clamp fixture in the X axis and determine a baseline position (see FIG. 8).

d. Clamp each sample individually in the fixture with ⅓ of its length held in the clamp. The clamp must not compress the sample (see FIG. 9).

e. Measure the exposed end of the sample from its bottom edge to the baseline and record that reading (see FIG. 10).

f. Clamp a 3 gram load on the exposed end (within 0.250" of the end) and measure the sample from its bottom edge to the baseline and record that reading (see FIG. 11).

g. Subtract the reading of step "f" from step "e" and record the difference. This gives a "deflection value" which is the flexural reading for this sample.

Based on this testing procedure and from prior experimentation which has been done by the applicant, the deflection value should be less than 1.2 inch, and desirably less than 1.0". More desirably, the deflection value would be less than 0.9", and no more than about 0.8", or 0.7". Quite satisfactory results have been achieved when the deflection value is about 0.6" or less. At the other end of the test spectrum, the reference deflection value is greater than 0.0 and desirably at least as great as 0.2, 0.3, or 0.4". Satisfactory results could be obtained by having deflection values between about 0.2 to 0.6".

While it would be possible to use a cover piece having no deflection at all, as indicated previously, it is desirable that there is a certain amount of flexibility to enable flexing of the cap. This is particularly so when the person is replacing the cap and the person wishes to visually see where the cap is being placed while the tab 52 is raised. This would require that the tab 52 could be bent upwardly, for example, at about possibly a half of a right angle (i.e. about 45 degrees), and then snapped down into place.

Within the broader scope of the present invention, it would be possible to deviate from the configuration of the cover piece 12, possibly to provide configurations in a more stylized form. Five examples are shown in FIGS. 12A–E.

In each of these five additional embodiments, the cover members are sized to provide a portion acting as the covering portion and the perimeter portion to adhere to the perimeter surface positions surrounding the container opening and also have a portion extending outwardly over the outer edge of the cover to serve the function of the tab 52 so as to able to be grasped between the person's finger and thumb.

Figure 12A:
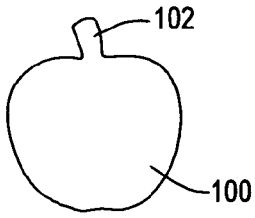
FIGS. 12A, 12B, 12C, 12D and 12E show five additional embodiments of the present invention where the cover pieces have various stylized configurations, indicating, somewhat schematically, an apple, a clover, a person's lips or lip, an image representing the sun, and a flower, respectively.

It can be seen that FIG. 12A is a somewhat stylized representation of an apple, which in this instance has a covering portion 100, and an extending portion 102, which simulates the stem of the apple.

Figure 12B:
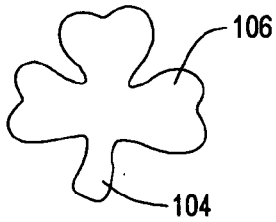

FIG. 12B is a stylized representation of a clover, and the cover piece 12B shows an extension piece 104 which would simulate a stem, and there are three portions simulating petals 106. It is to be understood, of course, that there should be sufficient surface area to cover the opening, and in this instance the two petals extending opposite from one another would have sufficient length and width dimension to serve this purpose.

Figure 12C:
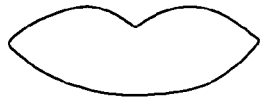

FIG. 12C is a representation of a person's lips, and in this configuration, there should be a sufficient length dimension to cover the opening and the width dimension should be great enough not only to cover the opening, but also to extend beyond the edge of the lid a moderate distance so that it could be grasped for easier removal.

Figure 12D:
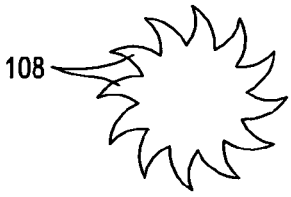

FIG. 12D shows a representation of a sun, with a central body portion and a number of radially extending portions 108, these being a stylized representation of the flames being emitted from the sun.

Figure 12E:
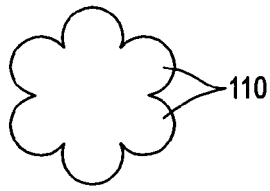

FIG. 12E shows a representation of a flower with there being a central body portion and petals 110 extending outwardly in a symmetrical pattern.

While these five embodiments shown in FIGS. 12A–E deviate from the configuration of the first referred embodiment shown in FIGS. 1–7, these embodiments of FIGS. 12A–E should have the flexural/stiffness characteristics that were described previously. By deviating from the configurations shown in FIGS. 1–7, there may be a certain reduction in the precision with which the cover piece can be positioned over the opening. However, if it has the proper flexural characteristics, these embodiments of FIGS. 12A–E would properly perform the covering function, and would still be able to be manipulated in a manner that each these could be grasped by side edges and properly placed over the opening of the cup lid, and be removed from the opening of the cup lid by the portion corresponding to the tab 52.

It is evident that various modifications could be made to the present invention without departing from the basic teachings thereof.

I claim:

1. A method of serving a beverage comprising the steps of:

providing a beverage container assembly comprises a cup and a lid, where the lid defines a drinking opening and comprises a curved upper wall extending around a perimeter of the lid, a recessed portion, and a positioning surface extending downwardly from the upper wall into the recessed portion adjacent to the drinking opening, where drinking opening is formed in the upper wall and the positioning surface is adjacent to the drinking opening;

filling the beverage container assembly with a hot beverage;

providing a substantially planar cover member comprising first and second layers and defining a cover portion, a surrounding cover portion, a tab portion, and a perimeter edge, where the perimeter edge defines an outer edge portion and an inward edge portion curved to conform to the curvature of the curved upper wall, where outer edge portion opposes the inward edge portion;

the first layer is a structural layer having flexural characteristics that allow the cover member to be transported by engaging the outer and inward edge portions of the perimeter edge of the cover member without substantially deforming the cover member from a substantially planar configuration;

the second layer defines a pressure sensitive adhesive surface adapted to detachably attach the cover member to the lid upon application of deliberate manual force on the cover member; whereby attaching the cover member to the container assembly in a cover mode by engaging the opposing outer and inner edge portions of the cover member with outer and inner digits, respectively, and applying manual pinching forces to the outer edge and inward edge portions to lift the cover member, aligning the curved inward edge portion of the perimeter edge with the curved upper wall by placing the inner digit against the positioning surface, and bringing the cover member into contact with the upper wall of the raised portion of the lid such that the adhesive surface on the surrounding cover portion of the cover member adheres the cover member to the lid, the surrounding cover portion extends completely around the drinking opening, the cover portion extends over the drinking opening, and at least a portion of the tab portion of the cover member extends radially outwardly into free space from the upper wall of the lid; and applying deliberate manual force to the tab portion of the cover member that extends into free space to overcome the adhesion of the second layer of the cover member to the lid and thereby detach the cover from the container assembly to allow the beverage to be drunk through the drinking opening.

2. A method as recited in claim 1, further comprising the step of re-attaching the cover member to the container assembly in the cover mode.

3. A method as recited in claim 1, in which the step of providing the cover member further comprises the steps of:

providing a substrate material; and arranging a plurality of cover members on the substrate material; and removing one of the cover members from the substrate material.

* * * * *